United States Patent [19]

Berger et al.

[11] Patent Number: 4,965,896

[45] Date of Patent: Oct. 30, 1990

[54] FOLDABLE DIAPER-CHANGING TABLE

[76] Inventors: Frederick Berger, 22 High Oak Ct., Huntington, N.Y. 11743; Mindy S. Berger, 52 Derby Pl., Smithtown, N.Y. 11787

[21] Appl. No.: 498,423

[22] Filed: Mar. 26, 1990

[51] Int. Cl.[5] ..... A47D 5/00

[52] U.S. Cl. ..... 5/424; 5/9.1

[58] Field of Search ..... 5/9 R, 133, 424; 108/47, 134, 152, 48

[56] References Cited

U.S. PATENT DOCUMENTS

| | | | |
|---|---|---|---|
| 598,761 | 2/1888 | Beckett | 108/48 |
| 665,535 | 1/1901 | Lein | 5/9 R |
| 1,459,826 | 6/1923 | Gosso | 5/9 R |
| 2,203,538 | 6/1940 | Meilink | 108/48 |
| 2,735,737 | 2/1956 | Hancock | 108/134 |
| 2,846,702 | 8/1958 | DePuy | 5/424 |
| 3,242,882 | 3/1966 | Hoyt | 108/48 |
| 3,967,333 | 7/1976 | Boyd | 5/424 |
| 4,216,951 | 8/1980 | Griffin | 108/134 X |
| 4,613,996 | 9/1986 | Chase et al. . | |
| 4,723,493 | 2/1988 | Siuni et al. | 108/134 |

*Primary Examiner*—Michael F. Trettel

[57] ABSTRACT

A fold-up table adapted to facilitate the process of changing a baby's diaper. The table includes a hollow rectangular tray that can be swung down to a horizontal position extending outwardly from a room wall to support a baby while the diaper is being changed. During non-use periods the tray can be swung to an upright position facing the room wall surface.

5 Claims, 1 Drawing Sheet

FOLDABLE DIAPER-CHANGING TABLE

BACKGROUND AND SUMMARY OF THE INVENTION

This invention relates to a fold-up table designed to facilitate the process of changing a baby's diapers. During non-use periods the table is swung upwardly to a position facing one wall of a room; the table takes up very little space in the room. When the baby's diaper needs to be changed the table is swung downwardly to a horizontal position extending outwardly from the room wall. The baby lays on the table during the diaper-changing process.

The table is preferably constructed as a hollow rectangular tray having a relatively flat bottom wall, a peripheral side wall extending entirely around the periphery of the bottom wall, and a rim wall extending outwardly from the side wall in a plane parallel to the plane of the bottom wall. The baby is positioned within the tray so that he/she cannot readily fall onto the floor, even if the mother's attention is momentarily directed away from the baby.

This fold-up table (tray) can be used in small clearance areas where it would not be possible or practical to use a conventional four legged baby-changing table, e.g. restrooms in restaurants, shopping malls, buses or airplanes, or in small apartments where space might be at a premium. The fold-up table is a relatively low cost device that is considerably cheaper than the corresponding piece of baby furniture.

THE DRAWINGS

DESCRIPTION OF A PREFERRED EMBODIMENT OF THE INVENTION

Figure 1:
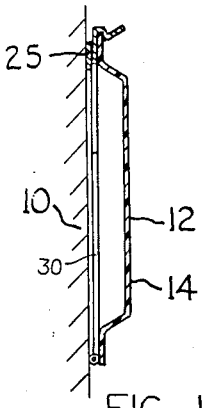
FIG. 1 is a sectional view taken through a fold-up table constructed according to the invention.
Figure 2:
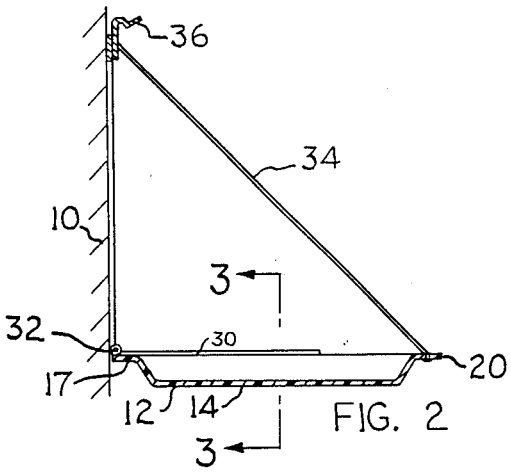
FIG. 2 is a sectional view in the same direction as FIG. 1, but showing the table swung down to a position suitable for use in changing a baby's diaper.

The drawings show a fold-up table especially designed for supporting a baby while the baby's diaper is being changed. FIG. 1 shows the table swung upwardly to a storage position facing a room wall 10. FIG. 2 shows the table swung down to a "use" position extending horizontally normal to room wall 10.

Figure 3:
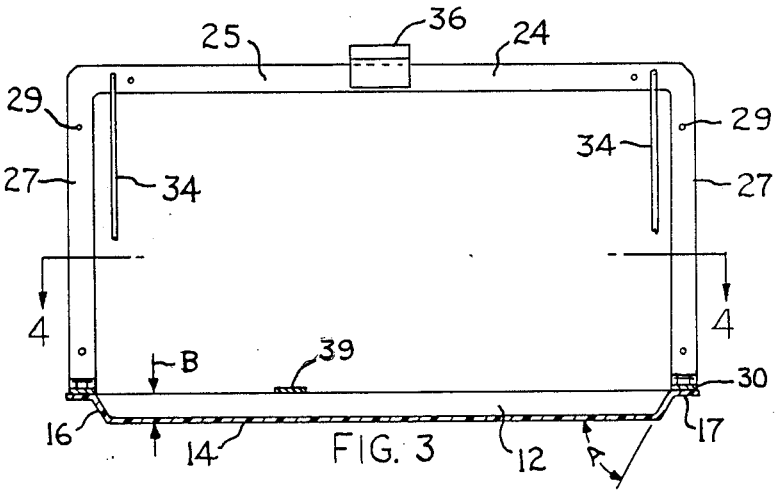
FIG. 3 is a sectional view taken on line 3—3 in FIG. 2.
Figure 4:
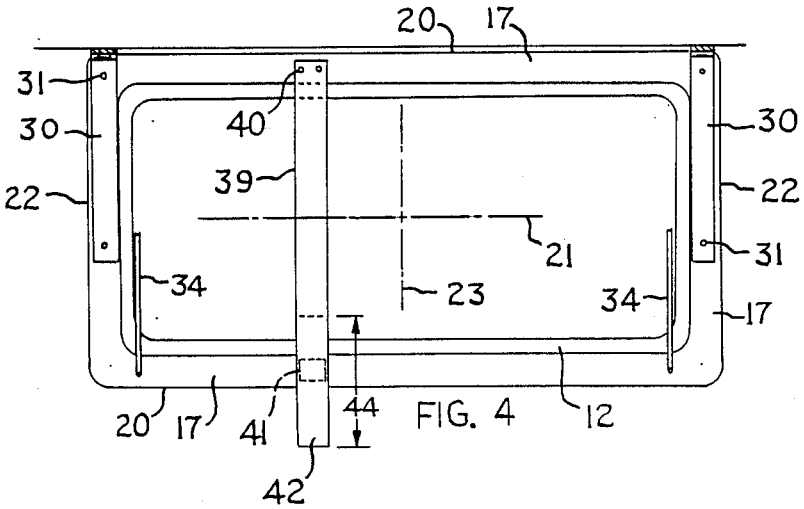
FIG. 4 is a sectional view taken on line 4—4 in FIG. 3.

The table comprises a hollow rectangular tray 12 formed as a one piece rigid plastic molded member. The tray includes a flat bottom wall 14 and a peripheral side wall 16 extending entirely around the periphery of bottom wall 14. Side wall 16 extends at an acute angle to the plane of wall 14 for ease in cleaning the corners between the two walls. As shown in FIG. 3, the angle A between the two walls may be approximately sixty degrees.

A flat rim wall 17 radiates outwardly from the edge of wall 16 in a plane that parallels the plane of bottom wall 14. Typically the depth dimension B of the tray may be about two inches.

As seen in FIG. 3, the tray is a rectangular structure having two longitudinal edges 20 and two transverse edges 22. The external corners of the tray may be rounded for ornamental and safety reasons. Longitudinal edges 20 of the tray define the major longitudinal axis 21 of the tray. Transverse edges 22 define the minor axis 23 of the tray.

Tray 12 is suspended on the room wall 10 by means of a flat bracket structure 24, preferably formed of steel. As shown in FIG. 3 the bracket structure comprises an upper horizontal strap element 25 and two downwardly extending vertical strap elements 27. Strap element 25 is optional in practice of the invention. Its primary purpose is to tie the two vertical strap elements 27 together for the purpose of facilitating an easy and precise attachment of the bracket structure to the room wall. Screws 29 may be used to attach the bracket structure flatwise on the wall 10 surface.

Two additional steel straps 30 are secured flatwise to rim wall 17 of the tray in near adjacency to the tray transverse edges 22. Screws 31 may be used for strap securement purposes. End areas of straps 27 and 30 are curled around hinge pins 32 to form hinged connections between the straps. The tray 12 can thus be swung up or down around the hinge axis to the FIG. 1 storage position or the FIG. 2 use position.

Two flexible cords 34 are trained between bracket structure 24 and the tray rim wall 17 to support the weight of the tray (and the baby) when the tray is in its FIG. 2 position. The cords 34 are located as close as possible to the transverse edges 20 of the tray so as not to act as obstructions against placement of the baby into the tray or lifting of the baby from the tray. A manually-operable latch arm 36, formed of a springy (resilient) material, is attached to bracket structure 24 for releasably retaining tray 12 in its FIG. 1 position.

Straps 27 and 30 are spaced slightly closer together than the length of tray 12 (measured along axis 21). Therefore, when the tray is in its FIG. 1 storage position the straps are substantially covered (concealed) by the tray. The tray presents an essentially flat planar appearance devoid of projections or mounting elements that would detract from the ornamental appearance of the tray. The tray tends to blend in with the room decor, without becoming an eyesore.

In use of tray 12 the baby is placed into the tray with his/her head near the left end of the tray (as viewed in FIG. (4). A flexible band 39 has an end 40 thereof anchored to rim wall 17 of the tray. End 42 of band 39 is free so that the band may be moved aside while the baby is being placed into the tray. Thereafter the band can be drawn over the lower chest area of the baby to restrain the baby against moving excessively during the diaper-changing process.

An anchoring device 41 is secured to rim wall 17 of the tray directly across from the band anchorage 40. Anchoring device 41 can be a patch of adhesive material formed with miniature fibrous hooks or loops. Such material is commercially available under the tradename VELCRO. A mating strip of miniature fibrous hook or loop material is carried on the face of band 39. This mating strip may be elongated to have a length dimension 44, whereby the band can selectively engage the adhesive patch 41 at different points along the band length, according to the size of the baby.

The baby will be positioned within tray 12, such that band 39 will naturally extend over the baby's chest or waist area without exerting an excessive or uncomfortable force. The restraint is a relatively light restraint.

This fold-up table can be made in various sizes. However, in a typical table construction the tray would have a length of about forty-two inches and a width of about twenty-two inches

We claim:

1. A fold-up table for changing a baby's diapers, comprising first and second horizontally spaced vertical straps adapted for securement against a room wall; a hollow rectangular tray that includes a flat bottom wall, a peripheral side wall extending entirely around the periphery of said bottom wall at an acute angle to the bottom wall plane, and a peripheral rim wall extending outwardly from said side wall in a plane that parallels the bottom wall plane; said rectangular tray having two longitudinal edges defining a tray major axis and two transverse edges defining a tray minor axis; third and fourth spaced straps secured flatwise to said rim wall of the tray; said third and fourth straps extending parallel to the minor axis of the tray at opposite transverse edges of the tray; a first horizontal axis hinged connection between said first strap and said third strap, and a second horizontal axis hinged connection between said second strap and said fourth strap, whereby the tray can be swung between an upright storage position facing the room wall and a use position extending horizontally normal to the room wall; said straps being located so as to be substantially covered by the tray when the tray is in its upright storage position.

2. The fold-up table of claim 1, and further comprising two flexible cords extending between the vertical straps and the peripheral rim wall of the tray for supporting the weight of the tray when the tray is in its horizontal use position.

3. The fold-up table of claim 2, and further comprising a flexible band having one end thereof anchored to the rim wall of the tray at a point near one of the tray longitudinal edges, and a band-retention device attached to the rim wall of the tray at a point near the other longitudinal edge of the tray; said flexible band having a free end thereof adapted to connect to said band-retention device so that the band extends transversely across the tray parallel to the minor axis of the tray; said flexible band being adapted to extend across the chest area of a baby lying on the tray, whereby the baby is deterred from moving during the diaper-changing process.

4. The fold-up table of claim 3, wherein the plane of the tray rim wall is spaced approximately two inches from the plane of the tray bottom wall.

5. The fold-up table of claim 4, wherein the tray is formed of a rigid plastic material.

* * * * *